US009296231B2

(12) United States Patent
Teraji

(10) Patent No.: US 9,296,231 B2
(45) Date of Patent: Mar. 29, 2016

(54) PRINTING APPARATUS AND POSTURE CHANGE CORRECTING METHOD FOR PRINT HEAD

(71) Applicant: CANON KABUSHIKI KAISHA, Tokyo (JP)

(72) Inventor: Tomoya Teraji, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/253,101

(22) Filed: Apr. 15, 2014

(65) Prior Publication Data

US 2014/0313250 A1 Oct. 23, 2014

(30) Foreign Application Priority Data

Apr. 23, 2013 (JP) ..... 2013-090373

(51) Int. Cl.
*B41J 25/00* (2006.01)
*B41J 19/20* (2006.01)
*B41J 29/393* (2006.01)

(52) U.S. Cl.
CPC ..... *B41J 25/003* (2013.01); *B41J 19/207* (2013.01); *B41J 2029/3935* (2013.01)

(58) Field of Classification Search
None
See application file for complete search history.

(56) References Cited

U.S. PATENT DOCUMENTS

| | | | | |
|---|---|---|---|---|
| 4,675,696 | A * | 6/1987 | Suzuki | 346/46 |
| 5,576,744 | A * | 11/1996 | Niikura et al. | 347/14 |
| 6,227,659 | B1 * | 5/2001 | Lopez et al. | 347/68 |
| 6,981,755 | B2 * | 1/2006 | Lim | 347/20 |
| 7,014,289 | B1 * | 3/2006 | Matsuda | 347/19 |
| 7,438,380 | B2 | 10/2008 | Ishikawa | |
| 8,727,496 | B2 * | 5/2014 | Plante | 347/49 |
| 2003/0020930 | A1 * | 1/2003 | Yagi | 358/1.8 |
| 2009/0009812 | A1 * | 1/2009 | Sirringhaus et al. | 358/3.26 |
| 2010/0309240 | A1 * | 12/2010 | Tomida et al. | 347/12 |

FOREIGN PATENT DOCUMENTS

JP 2007-090875 A 4/2007

* cited by examiner

*Primary Examiner* — Justin Seo
(74) *Attorney, Agent, or Firm* — Fitzpatrick, Cella, Harper & Scinto

(57) ABSTRACT

In a printing apparatus, print position shift caused by a posture change of a print head is appropriately reduced irrespective of causes of the posture change. Specifically, a test pattern is printed, and then, an inclination of a carriage is calculated based on the read result. On this test pattern appears, for example, not only landing position shift caused by the rolling posture change of the carriage but also synthesized position shift caused by a plurality of kinds of posture changes of the carriage. That is to say, on the test pattern to be printed can appear synthesized position shift caused by a plurality of kinds of posture changes occurring on a print head at this time. The posture of the carriage is corrected in such a manner as to suppress the synthesized position shift.

8 Claims, 19 Drawing Sheets

PRINTING APPARATUS AND POSTURE CHANGE CORRECTING METHOD FOR PRINT HEAD

BACKGROUND OF THE INVENTION

1. Field of the Invention

The present invention relates to a printing apparatus and a posture change correcting method for a print head and, more particularly, to a technique for reducing print position shift caused by a posture change of a print head while scanning.

2. Description of the Related Art

In a printing apparatus in which a print head scans a print medium so as to perform printing, the posture of the print head while scanning may be changed, which is caused by, for example, an incorporation error of a guide member for guiding the movement of the print head for scanning. The posture change of the print head of, for example, an ink jet system shifts the landing position of ink ejected from the print head on a print medium from a target position, and thus, shifts the position of an ink dot to be formed on the print medium. This is called print position shift.

Japanese Patent Laid-Open No. 2007-090875 discloses a method for reducing print position shift caused by the posture change of a print head. Specifically, a sensor for detecting the posture change of a print head is provided and the posture of the print head is corrected based on the detection result from the sensor by a piezoelectric element, so that print position shift is reduced.

However, in a case where the sensor detects the posture change of the print head, as disclosed in Japanese Patent Laid-Open No. 2007-090875, there arises a problem that the sensor detects only the posture change in a predetermined direction. More specifically, the detection of the posture change by the sensor disclosed in Japanese Patent Laid-Open No. 2007-090875 cannot cope with print position shift in a case where the combination of causes of posture changes in a plurality of directions induces print position shift in a predetermined direction.

SUMMARY OF THE INVENTION

An object of the present invention is to provide a printing apparatus and a posture change correcting method for a print head, in which print position shift caused by the posture change of a print head can be properly reduced irrespective of the cause of the posture change.

In a first aspect of the present invention, there is provided a printing apparatus comprising: a moving unit configured to mount a print head and move in a first direction; a pattern printing unit configured to cause the print head to print a test pattern on a print medium, wherein the pattern printing unit causing the print head to print the test pattern at each of a plurality of different positions in the first direction; a measuring unit configured to optically measure the plurality of test pattern printed on the print medium; an obtaining unit configured to obtain a displacement of the print head in a different direction from the first direction, based on a measured result by the measuring unit; and a correction unit configured to correct a posture of the print head based on an obtained result by the obtaining unit.

In a second aspect of the present invention, there is provided a printing apparatus comprising: a moving unit configured to mount a print head and move in a first direction; a pattern printing unit configured to cause the print head to print a test pattern on a print medium, wherein the pattern printing unit causing the print head to print the test pattern at each of a plurality of different positions in the first direction; a measuring unit configured to optically measure the plurality of test pattern printed on the print medium; and a correction unit configured to correct a posture of the print head by turning the moving unit corresponding to an angular displacement of the print head based on a measured result.

In a third aspect of the present invention, there is provided a posture change correcting method for a print head comprising: a step of providing a moving unit configured to mount a print head and move in a first direction; a step of causing the print head to print a test pattern on a print medium, wherein the pattern printing step causing the print head to print the test pattern at each of a plurality of different positions in the first direction; a step of optically measuring the plurality of test pattern printed on the print medium; a step of obtaining a displacement of the print head in a different direction from the first direction, based on a measured result in the measuring step; and a step of correcting a posture of the print head based on an obtained result in the obtaining step.

In a fourth aspect of the present invention, there is provided a posture change correcting method for a print head comprising: a step of providing a moving unit configured to mount a print head and move in a first direction; a step of causing the print head to print a test pattern on a print medium, wherein the pattern printing step causing the print head to print the test pattern at each of a plurality of different positions in the first direction; a step of optically measuring the plurality of test pattern printed on the print medium; and a step of correcting a posture of the print head by turning the moving unit corresponding to an angular displacement of the print head based on a measured result.

With the above-described configuration, the print position shift caused by the posture change of the print head can be properly reduced irrespective of the cause of the posture change.

Further features of the present invention will become apparent from the following description of exemplary embodiments (with reference to the attached drawings).

DESCRIPTION OF THE EMBODIMENTS

An embodiment of the present invention will be described below with reference to the attached drawings.

Figure 1:
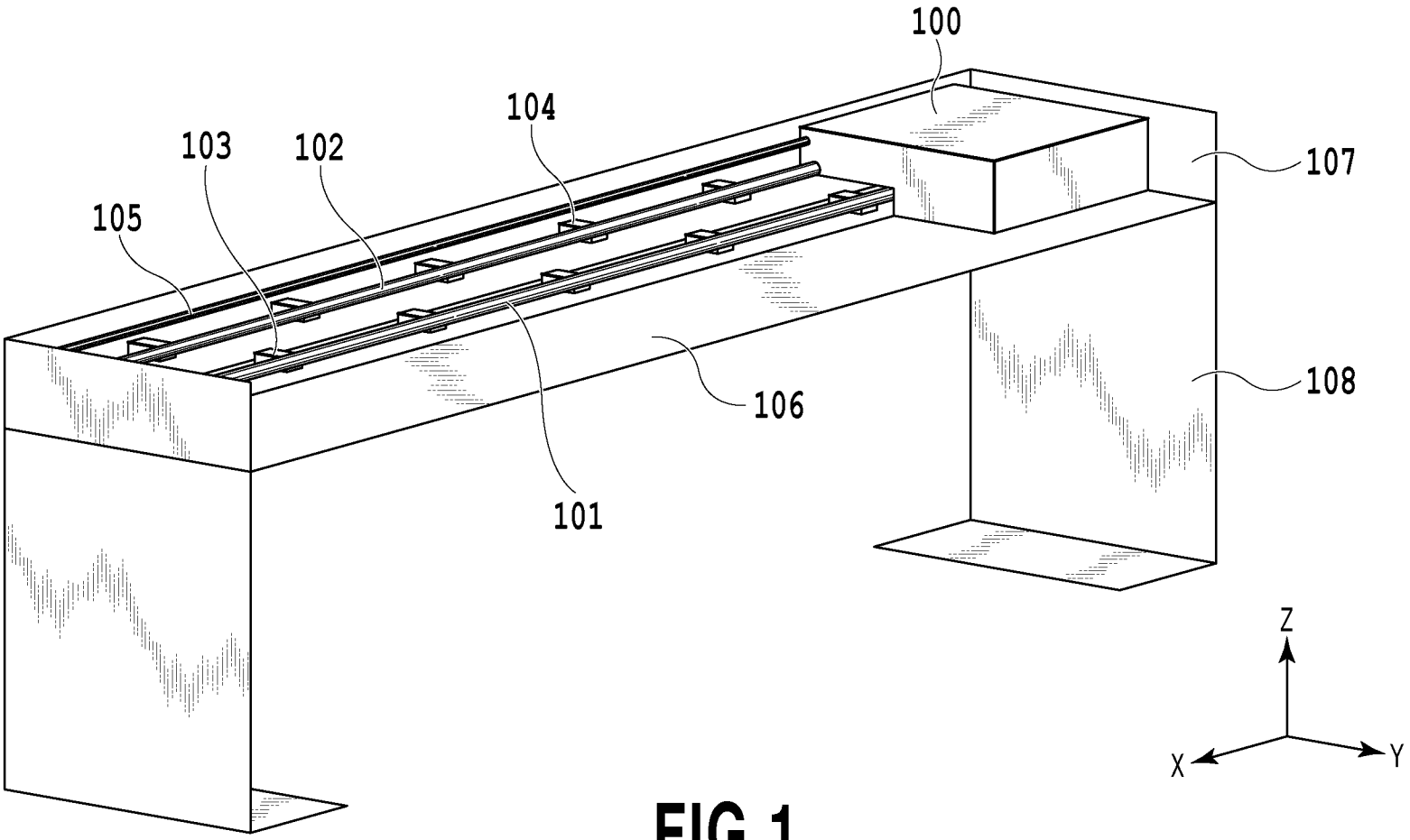
FIG. 1 is a perspective view showing the schematic configuration of an ink jet printing apparatus according to one embodiment of the present invention.

FIG. 1 is a perspective view showing the schematic configuration of an ink jet printing apparatus according to one embodiment of the present invention. In FIG. 1, a carriage 100 mounts a print head thereon, and can move forward and reversely in an X direction, which is referred to as a main scanning direction, by power of a carriage motor, not shown. The movement of the carriage 100 allows the print head to scan a print medium such as a print sheet while ejecting ink based on print data, so as to perform printing. A main rail 101 is provided in such a manner as to extend in the main scanning direction in the apparatus, for guiding and supporting the movement of the carriage 100 in the main scanning direction. The main rail 101 is fixed at both ends thereof to an upper casing 107, and further, is supported upward by a plurality of main rail support members 103. Consequently, it is possible to suppress flexure at an intermediate portion, the flexure being caused by the weight of the main rail 101 or the like. A sub rail 102 is provide in a parallel to the main rail 101, for holding the posture of the carriage 100 to be guided by the main rail 101. In the same manner, the sub rail 102 is fixed to the upper casing 107 via a plurality of sub rail support members 104, thus suppressing flexure at an intermediate portion caused by its own weight of the sub rail or the like.

A carriage encoder 105 is provide in parallel to the main rail 101. A carriage encoder sensor, not shown, is mounted on the carriage 100. Therefore, the carriage encoder sensor can read the carriage encoder 105, thus detecting the movement position of the carriage 100, that is, the scanning position of the print head.

A platen 106 is formed of a flat plate, and supports upward a print medium, not shown, conveyed to a position, at which the print head can perform printing. The print medium is conveyed in a sub scanning direction (i.e., a Y direction) on the platen 106 according to the rotation of a conveyance roller, not shown. The platen 106, the conveyance roller, and the like are fixed to a lower casing 108. The configuration of the upper casing 107 and the configuration of the lower casing 108 are combined with each other to thus constitute main elements of a printing apparatus in the present embodiment.

Figure 2:
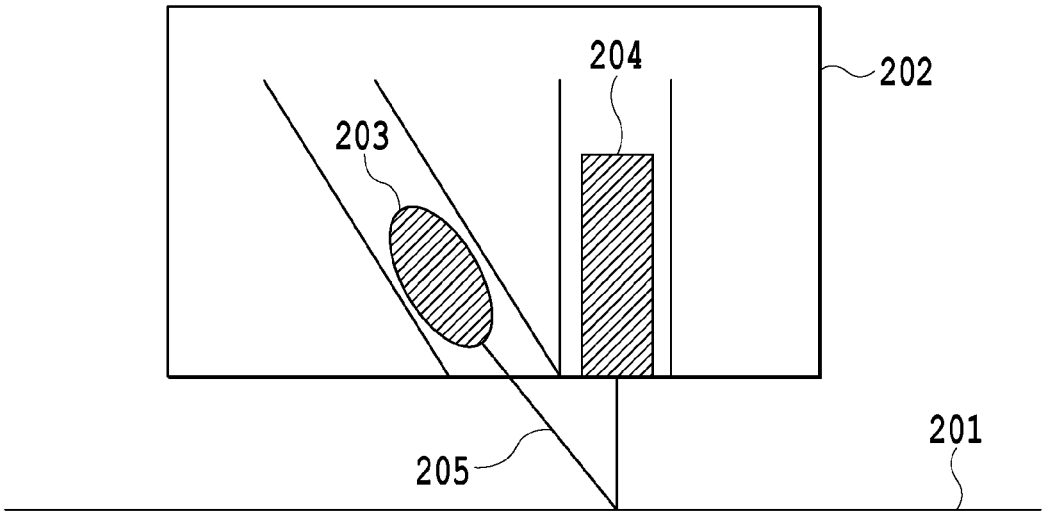
FIG. 2 is a view schematically showing the configuration of an optical sensor for detecting the density of a patch in the printing apparatus according to the embodiment of the present invention.

FIG. 2 is a view schematically showing the configuration of an optical sensor for detecting the density of a patch in the printing apparatus of the present embodiment. An optical sensor 202 is mounted on the carriage 100, for optically detecting the density of a patch, described later, printed on a print medium 201 according to the movement of the carriage. The sensor 202 is provided with a light emitting unit 203 and a light receiving unit 204. A light beam emitted from the light emitting unit 203 is reflected on an object, and then, the light receiving unit 204 detects a reflected light beam. The reflection on an object is classified into regular reflection and diffused reflection. In order to accurately detect the density of an image printed on an object, that is, the print medium 201, a light beam resulting from diffused reflection should be desirably detected. In view of this, the light receiving unit 204 in the optical sensor 202 in the present embodiment is located at a position out of the reflection angle of an incident light beam 205.

Figure 3:
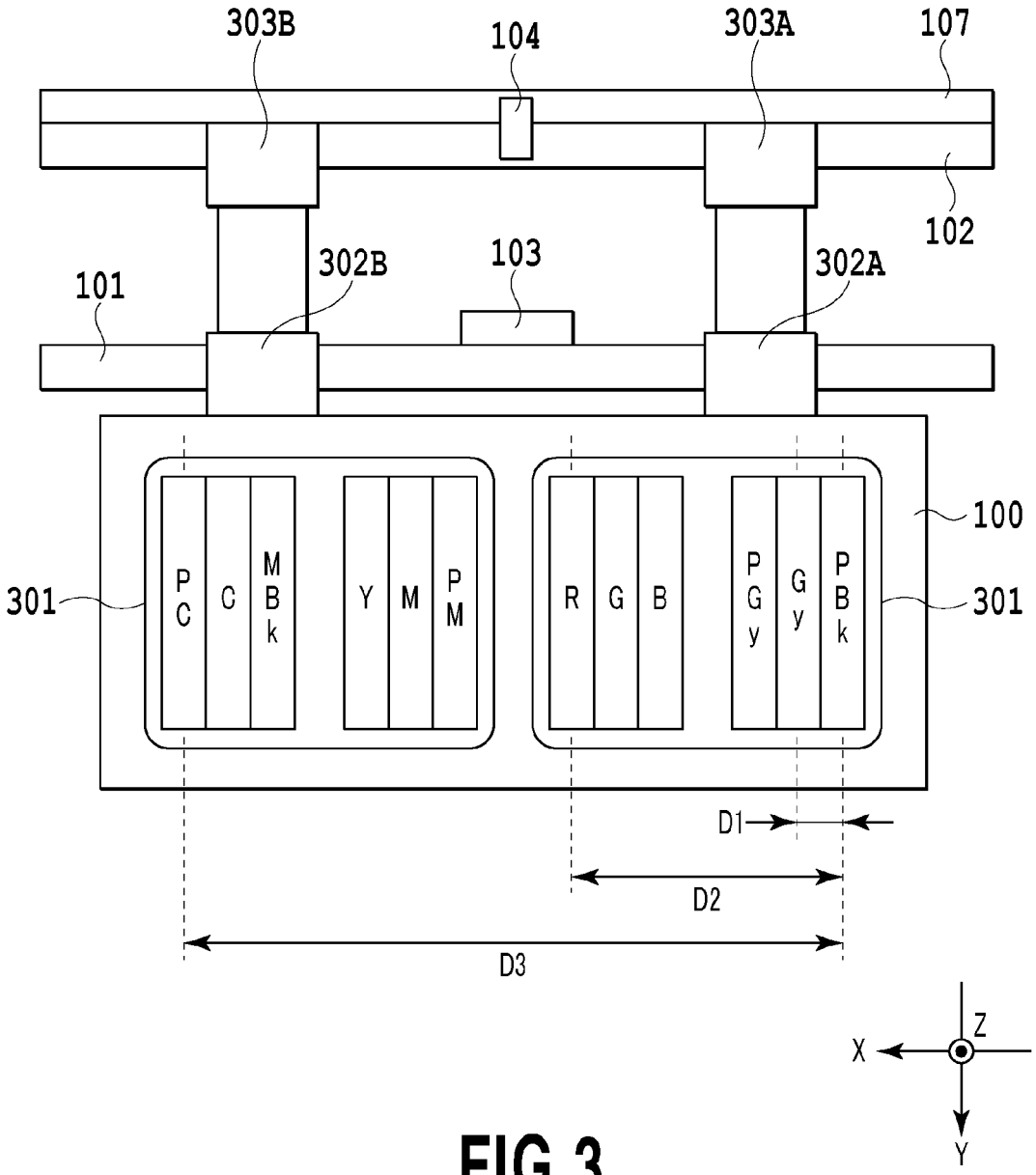
FIG. 3 is a diagram illustrating the configuration of a carriage to be used in the embodiment of the present invention and the arrangement of respective nozzle arrays of color inks in a print head mounted on the carriage.

FIG. 3 is a diagram illustrating the configuration of the carriage 100 to be used in the present embodiment and the arrangement of respective nozzle arrays of color inks, the nozzle arrays being disposed in a print head 301 mounted on the carriage 100. In a nozzle array of each of color inks, a plurality of nozzles (i.e., print elements) for ejecting ink are arrayed in the Y direction. The carriage 100 is guided and supported by the main rail 101 and the sub rail 102 so that the carriage can move forward and reversely in the X direction in FIG. 3. In this case, two carriage bearing members 302A and 302B connect the carriage 100 and the main rail 101 to each other, and further, two sub rail bearing members 303A and 303B connect the carriage 100 and the sub rail 102 to each other. Here, in a case where the main rail 101 is flexed, the flexure acts on the carriage 100, and further, the print head via the two carriage bearing members 302A and 302B, thereby causing the posture change of the print head. In addition, in a case where the sub rail 102 is flexed, the flexure acts on the print head via the sub rail bearing members 303A and 303B in the same manner, thereby causing the posture change of the print head. Generally, a flexure obtained by synthesizing the flexures of the main rail 101 and the sub rail 102 acts on the print head, and eventually, it appears as the posture change of the print head.

Incidentally, the flexure of the main rail 101 is suppressed by the plurality of main rail support members 103 whereas the flexure of the sub rail 102 is suppressed by the plurality of sub rail support members 104. However, slight flexure that cannot be completely suppressed due to the distance between the support members may remain. Moreover, the main rail 101 or the sub rail 102 may be slightly flexed during fabrication or incorporation of the rails.

In the carriage 100 of the present embodiment are mounted the two print heads 301 in such a manner as to be arranged in the main scanning direction. Nozzle arrays for a plurality of color inks are formed in each of the print heads 301. Each of the nozzle arrays includes a plurality of nozzles aligned in the Y direction. Furthermore, in the present embodiment, four nozzle arrays, not shown, for each of the color inks are arranged in the main scanning direction (i.e., the X direction), and they form a nozzle group for ejecting one of the color inks. In the present embodiment, nozzle groups for six color inks are arranged in the main scanning direction in one print head, as illustrated in FIG. 3. In FIG. 3, in the left print head 301 are arranged nozzle groups for ejecting inks of photo cyan (PC), cyan (C), mat black (MBk), yellow (Y), magenta (M), and photo magenta (PM) from left in order. In the meantime, in the right print head 301 are arranged nozzle groups for ejecting inks of red (R), green (G), blue (B), photo gray (PGy), gray (Gy), and photo black (PBk) from left in order. In the print head in the present embodiment, an inter-nozzle distance D1 between the adjacent nozzle groups for the color inks (i.e., the nozzle arrays corresponding to each other in performing printing) is 3.471 (mm), and further, an inter-nozzle distance D2 between the nozzle groups for the color inks at both ends of one print head is 24.298 (mm). Moreover, an inter-nozzle distance D3 between the nozzle groups for the color inks at both ends in the two print heads is 100.498 (mm).

Figure 4:
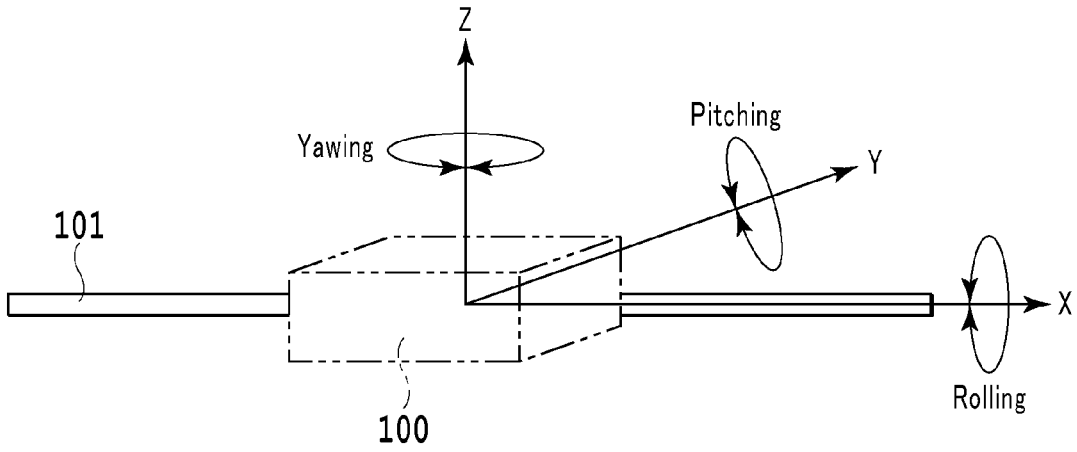
FIG. 4 is a view explaining the posture change of the carriage illustrated in FIGS. 1 and 3.

FIG. 4 is a view explaining the posture change of the carriage 100 illustrated in FIGS. 1 and 3. An example illustrated in FIG. 4 indicates directions of posture changes occurring in a case where the carriage moves along the main rail 101. The posture changes illustrated in FIG. 4 occur in the same manner in a case where the carriage moves along the sub rail 102. Here, the posture change is explained with reference to three X-, Y-, and Z-axes that are perpendicular to each other. The X-, Y-, and Z-axes are defined as follows. In the example illustrated in FIG. 4, an axis of a virtual straight line of the main rail 101 is referred to as the X-axis; an axis passing a surface of the carriage 100, facing the main rail, and crossing the X-axis is referred to as the Y-axis; and an axis crossing both of the X-axis and the Y-axis is referred to as the Z-axis. As is found from this definition, the Y-axis and the Z-axis are moved according to the movement of the carriage 100.

The description will be given below of one example in which the main rail 101 is curved in the Z direction while the sub rail 102 is not curved or deformed. In this case, in a case where the carriage 100 moves, the posture of the carriage is changed in the Z direction according to the curve. At this time, the sub rail 102 is not deformed, and therefore, the carriage is turned around the sub rail 102 due to the change in the Z direction. Here, since a turn angle is relatively small, the turn is expressed as a posture change caused by a turn around the main rail 101 (hereinafter this posture change is referred to as "rolling") in the example illustrated in FIG. 4. Additionally, there may occur a posture change caused by a turn around the Y-axis due to the curve in the Z direction (hereinafter this posture change is referred to as "pitching"). Moreover, in a case where the main rail 101 is curved in the Y direction, a posture change also may be caused by a turn of the carriage 100 around the Z-axis (hereinafter this posture change is referred to as "yawing"). Incidentally, in the printing apparatus in the present embodiment, the posture change (yawing) of the carriage caused by the curve of the main rail in the Y direction is assumed to be suppressed by the accurate adjustment of the main rail.

Figure 5:
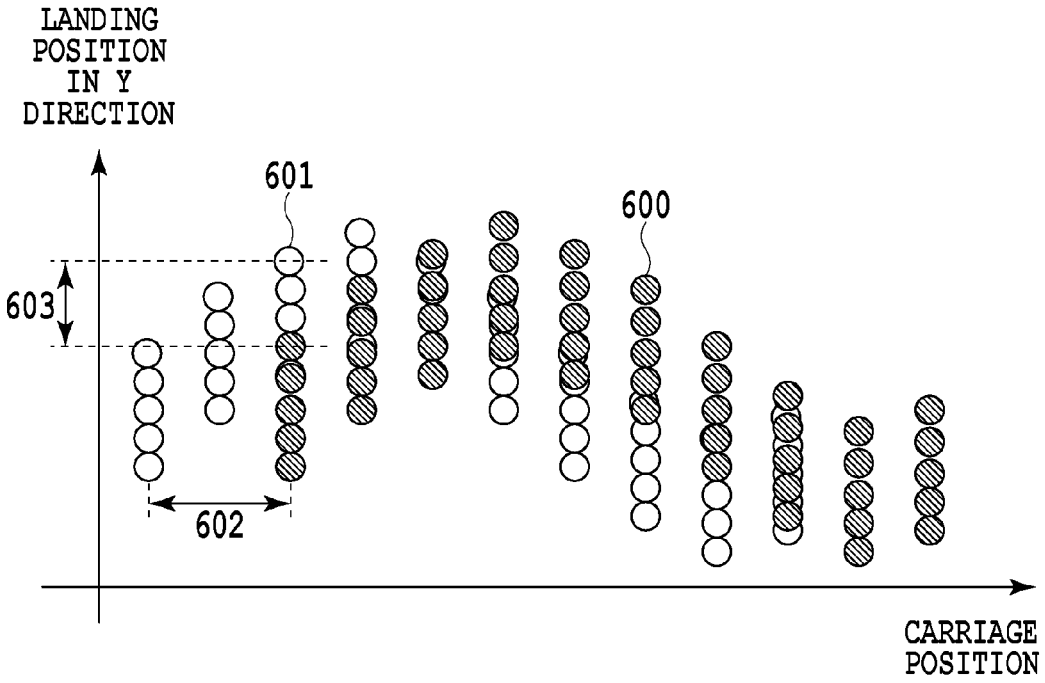
FIG. 5 is a diagram illustrating landing position shift in a Y direction, wherein the landing position shift occurs between nozzle arrays for two color inks due to a posture change by rolling of the carriage, or the print head.

FIG. 5 is a diagram illustrating landing position shift in the Y direction, which occurs between the nozzle arrays for two color inks, caused by the posture change by the rolling of the carriage, or the print head. A nozzle (or array) located forward is referred to as a preceding nozzle (array) in a carriage movement direction: in contrast, a nozzle (array) located backward of the preceding nozzle (array) is referred to as a following nozzle (array). FIG. 5 illustrates a case where the carriage moves from left to right. In a case where ink is ejected at the same position on the print medium (i.e., the same position at the "carriage position" illustrated in FIG. 5), a dot 600 is printed with ink ejected from the preceding nozzle, and then, the carriage moves by a distance 602 between the preceding nozzle and the following nozzle, so that a dot 601 is printed with ink ejected from the following nozzle. In this case, the above-described posture change of the carriage occurs while the carriage moves by the distance 602 between the nozzles, resulting in print position shift equivalent to landing shift amount 603 in the Y direction between the dot 600 formed by the preceding nozzle and the dot 601 formed by the following nozzle.

Here, the example illustrated in FIG. 5 shows the landing position shift caused by the posture change due to only the rolling, as described above. However, the landing position shift may be regarded as synthesized position shift caused by the plurality of kinds of posture changes of the print head described above with reference to FIG. 4. Specifically, as described above with reference to FIG. 4, in a case where, for example, the main rail 101 is curved in the Z direction, not only the rolling posture change but also the pitching posture change occurs, and accordingly, print position shift in the Y direction occurs. The position shift in the Y direction appears as position shift synthesized with the position shift caused by the rolling. In contrast, in the embodiment of the present invention, a test pattern formed of patches is previously printed, and then, the landing position shift in one direction such as the Y direction is detected based on the print density of the patch to be detected, as described later. Consequently, the synthesized position shift caused by the plurality of kinds of posture changes of the print head occurring at that time can appear on the patch to be printed. In the embodiment of the present invention, the posture of the carriage is corrected in such a manner as to cancel the synthesized position shift. Like in the present embodiment, in an apparatus in which two guide members for a main rail and a sub rail are provided for moving a carriage, it is to be understood that print position shifts due to posture changes caused by distortions of the two guide members also are synthesized, to be thus expressed as the density of the patch.

Figure 6A:
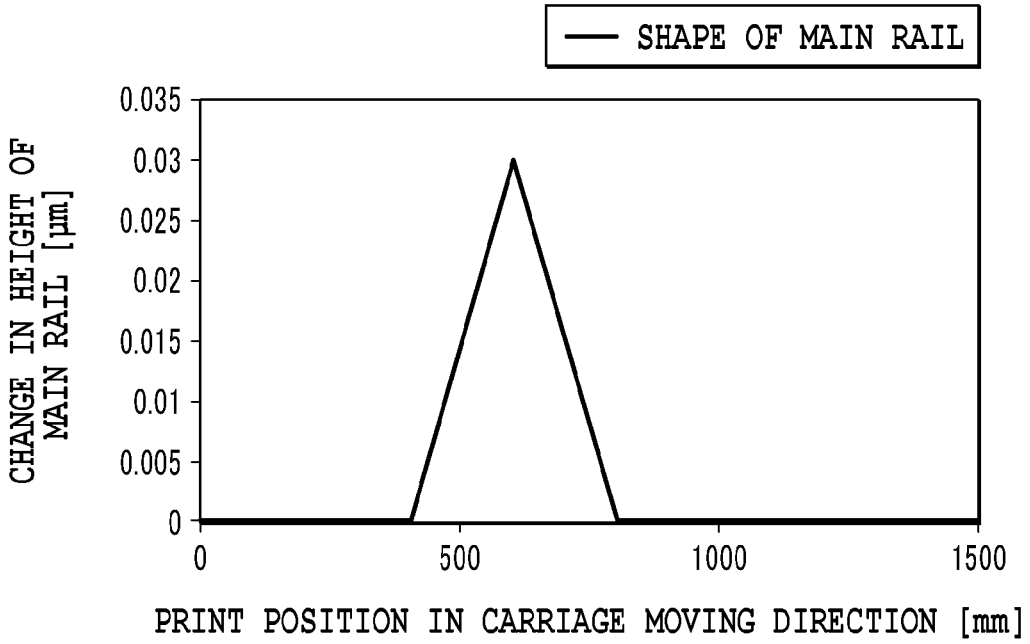
FIGS. 6A and 6B are graphs illustrating a change in shape of a main rail and print position shift accordingly.
Figure 6B:
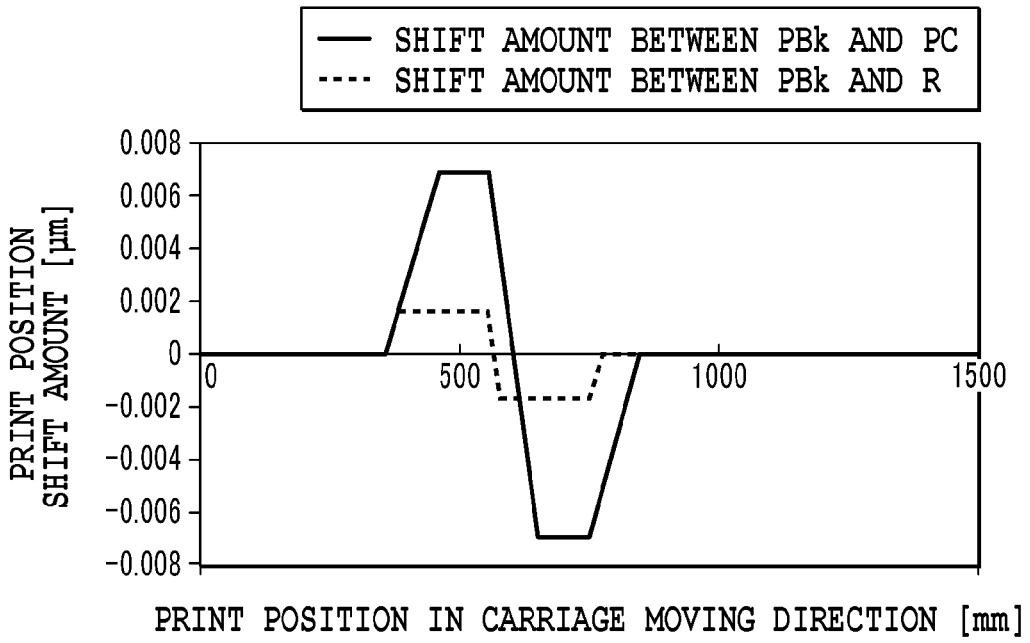

FIGS. 6A and 6B are graphs illustrating a change in shape of the main rail and the print position shift according to the change in shape. Here, FIG. 6A illustrates an example of a change in shape of the main rail, and FIG. 6B illustrates the print position shift between two nozzles in a case where the carriage moves at the time of the occurrence of the change in shape illustrated in FIG. 6A. As described above with reference to FIG. 3, the distance D3 between the nozzle array for the ink PBk and the nozzle array for the ink PC is greater about four times than the distance D2 between the nozzle array for the ink PBk and the nozzle array for the ink R. Consequently, the relative landing position shift caused by a change in height of the main rail generally becomes greater in the combination of the nozzles having the greater inter-nozzle distance. The same as the relative landing position shift caused by the change in height of the main rail goes for relative landing position shift caused by a change in height of the sub rail.

Figure 7:
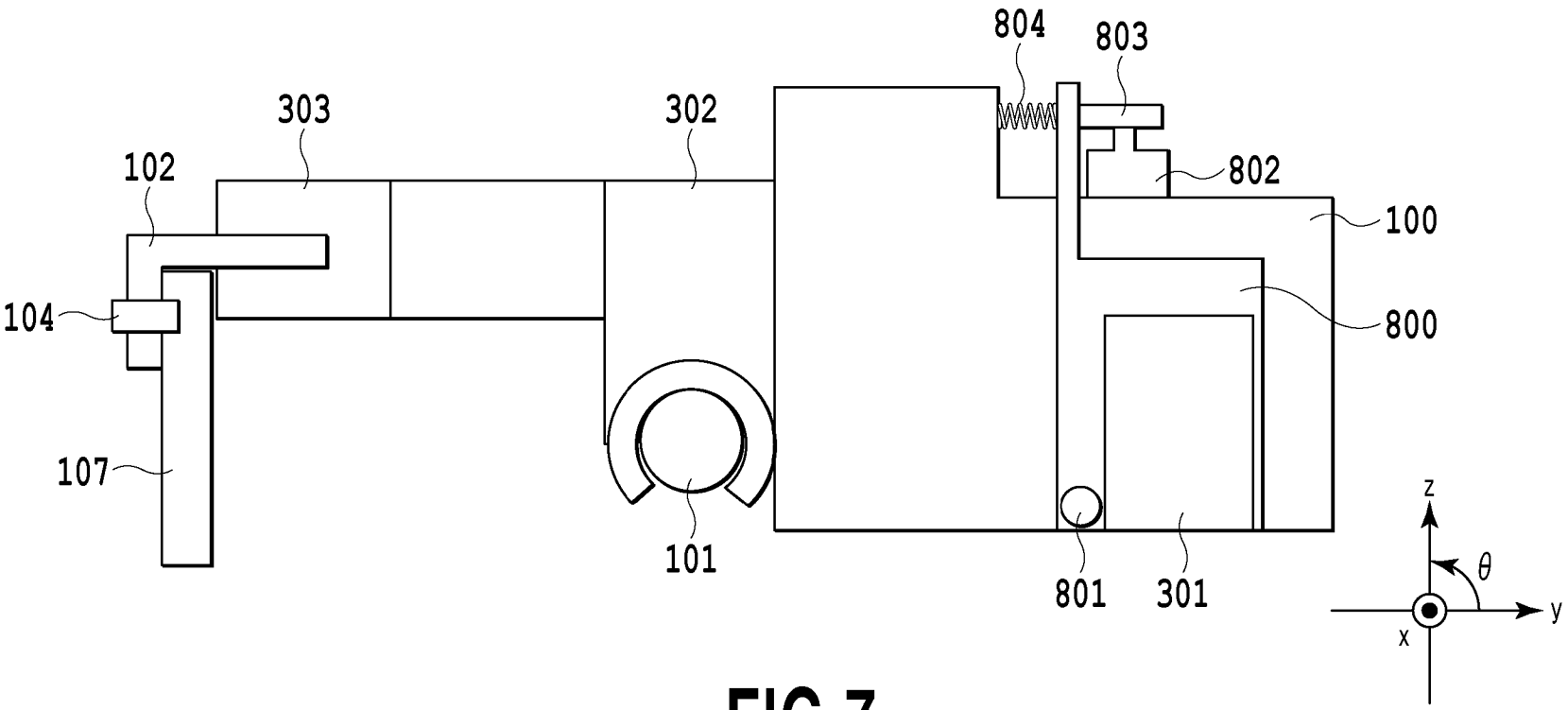
FIG. 7 is a side cross-sectional view schematically showing the carriage and a configuration for correcting the posture of the carriage in the embodiment of the present invention.

FIG. 7 is a side cross-sectional view schematically showing the carriage and a configuration for correcting the posture of the carriage in the present embodiment. The carriage 100 is provided with a print head container 800 containing the print head 301 therein. The print head container 800 is secured to the carriage 100 in such a manner as to be freely turned on a shaft 801. Moreover, to the carriage 100 is attached a pulse motor 802 that is adapted to provide drive force in correcting the posture of the carriage. A cam 803 is fixed to the pulse motor 802. The cam 803 is turned in contact with the upper end of the print head container 800, thus displacing the print head container 800 in the Y direction. The displacement in the Y direction by the function of the cam 803 enables the print head container 800 to be turned on the shaft 801 in a direction indicated by an arrow θ. Incidentally, the turn position of the print head container 800 is determined according to the stop position of the cam 803. Moreover, the contact point between the cam 803 and the upper end of the container is located at the middle of the width of the carriage in the main scanning direction.

Figure 8:
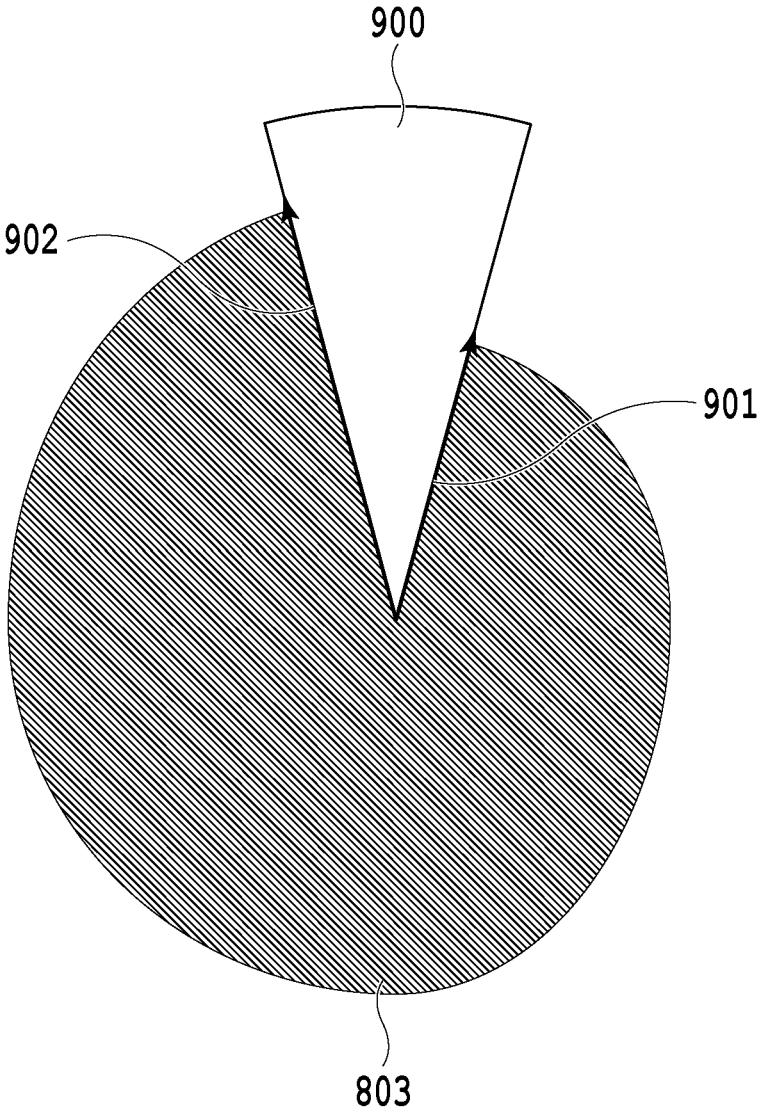
FIG. 8 is a plan view showing the shape of a cam to be fixed to a pulse motor shown in FIG. 7.

FIG. 8 is a view showing the shape of the cam 803 to be fixed to the pulse motor shown in FIG. 7. In the cam 803, the linear distance from the center of the rotation to the circumference is different according to the angle of the rotation. The displacement is produced at the contact point on the circumference, so that the print head container is turned. A position reference plate 900 is fixed to the cam 803. A photointerrupter attached to the carriage detects the edge of the position reference plate 900 as a reference position. Respective edges of the position reference plate 900 correspond to a minimum displacement point 901 and a maximum displacement point 902 produced by the cam, respectively.

Figure 9:
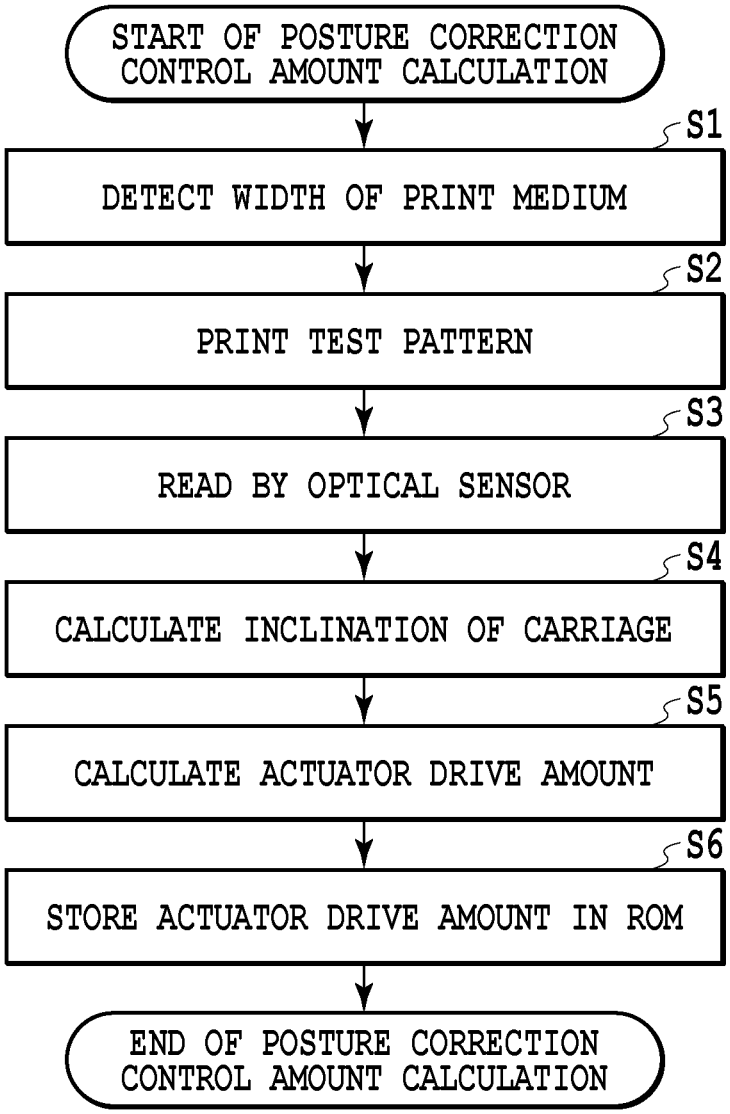
FIG. 9 is a flowchart illustrating a carriage posture correction control amount calculation according to the embodiment of the present invention.

FIG. 9 is a flowchart illustrating a carriage posture correction control amount calculation according to the embodiment of the present invention.

Upon start of a carriage posture correction control amount calculation mode, first, the width of a print medium to be used in printing a test pattern, described later, is detected by the optical sensor 202 in step S1. The intensities of reflected light emitted from the light emitting unit 203 are largely different from each other in a region in which the print medium is placed and a region in which a platen is exposed, and therefore, the detection of the intensities enables the existence of the print medium to be detected, that is, the width of the print medium to be measured. At this time, the sensitivity of the optical sensor 202 may be sequentially adjusted by utilizing the blank area of the print medium. Specifically, the carriage is moved up to a position at which the optical sensor 202 detects the blank area, and then, a detection amplifier disposed in the light receiving unit 204 is adjusted until a detection signal output from the light receiving unit 204 reaches a predetermined upper limit. The intensity of the reflected light incident into the light receiving unit 204 is varied according to the type of print medium. In addition, the intensity of a received light is varied also according to a distance from the print medium. Consequently, the sensitivity is adjusted with respect to the print medium, on which the test pattern is to be printed, in the above-described manner before the test pattern is actually detected. Thus, an S/N ratio is increased, and therefore, the relative density between patches can be acquired with a higher sensitivity. Here, the above-described sensitivity adjustment of the optical sensor 202 is not always needed. Moreover, the width of the print medium may not always be detected by using the optical sensor 202. For example, a user may designate the size of a sheet.

The printing apparatus of the present embodiment is relatively large in size, and therefore, it can print a large-sized print medium; at the same time, it can cope with the use of a narrower roll sheet. In this case, a relatively wider print medium need not be prepared only for the posture correction control amount calculation. A roll sheet is supplied and conveyed in a blank state in which the roll sheet does not undergo a printing operation, and then, is cut at a position of a length equivalent to a movement region width of the carriage, and thereafter, the cut roll sheet can be supplied again into the apparatus in such a manner as to be moved to a movement region.

In next step S2, the test pattern is printed on the supplied print medium.

Figures 10A, 10B, 10C:
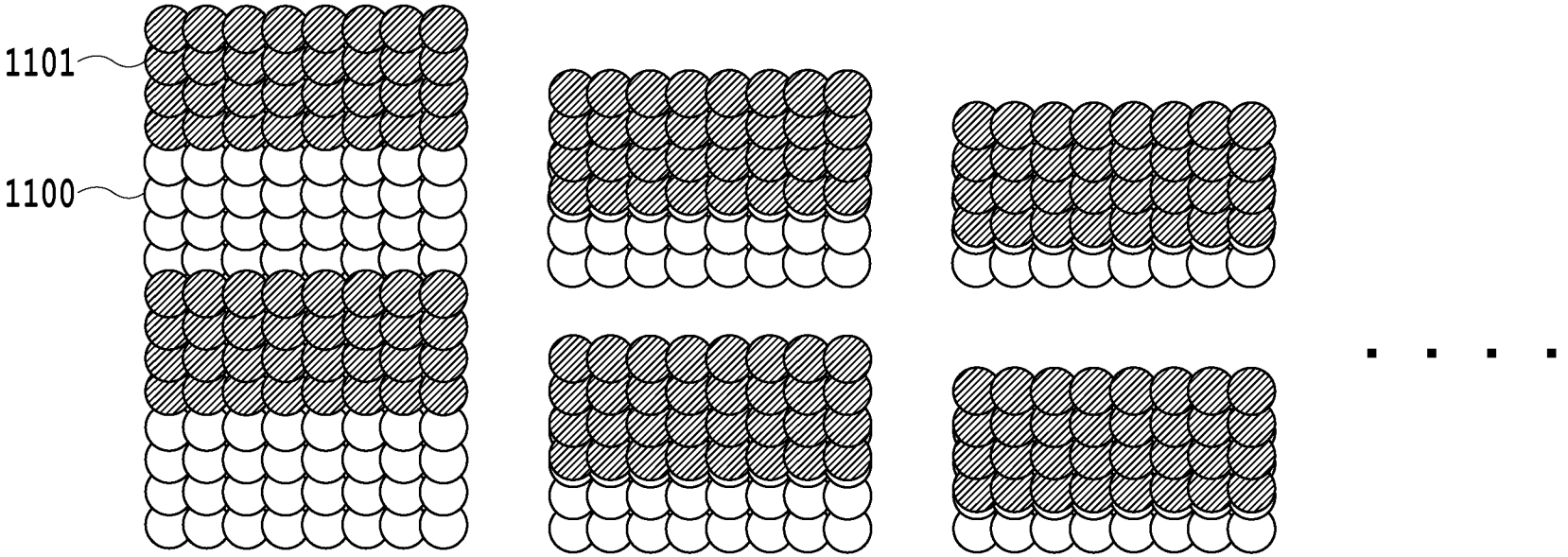
FIGS. 10A to 10C are diagrams illustrating states in which patches are printed according to the embodiment of the present invention.

FIGS. 10A to 10C are diagrams illustrating a state in which a patch is printed according to the present embodiment. FIGS. 10A to 10C illustrates patches having different shift amounts of dots printed by the preceding nozzles and the following nozzles, respectively. In FIGS. 10A to 10C, blank circles 1100 indicate dots printed by the preceding nozzles whereas solid circles 1101 indicate dots printed by the following nozzles.

FIG. 10A illustrates a patch in a state in which position shift corresponding to four pixels is made to occur between print positions by the preceding nozzles and the following nozzles. Moreover, FIG. 10B illustrates a patch in a state in which position shift corresponding to two pixels is made to occur between print positions by the preceding nozzles and the following nozzles. Additionally, FIG. 10C illustrates a patch in a state in which position shift corresponding to one pixel is made to occur between print positions by the preceding nozzles and the following nozzles. In this manner, the plurality of patches on the test pattern are obtained by artificially varying the position shift between the print positions by a predetermined amount, followed by printing, the position shift corresponding to an angular displacement in a predetermined direction of the print head. Ejection nozzles in the sub scanning direction of the following nozzles are varied with respect to the preceding nozzles, thus implementing a change in shift amount in the present embodiment.

Figure 11:
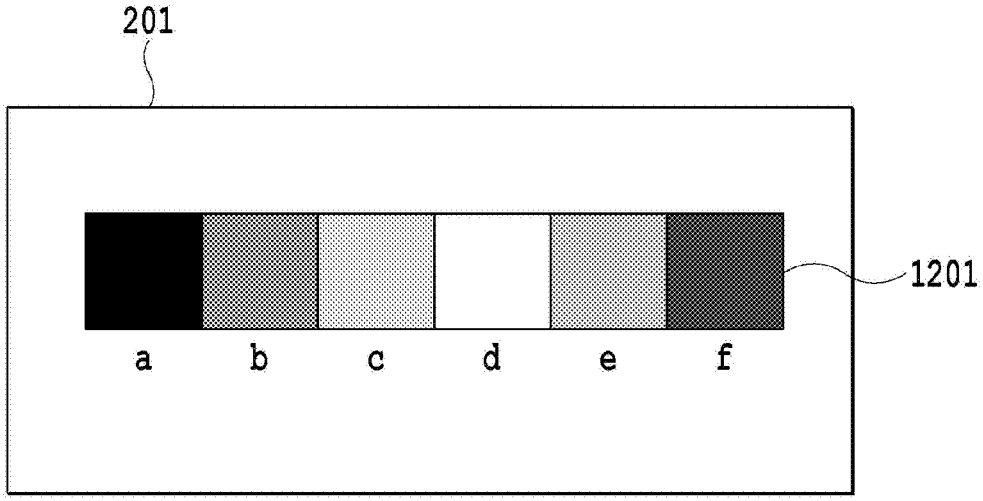
FIG. 11 is a diagram illustrating a patch group formed by arranging the plurality of patches having different shift amounts illustrated in FIGS. 10A to 10C.

FIG. 11 is a diagram illustrating a patch group formed by arranging the plurality of patches having the above-described different shift amounts. In FIG. 11, reference characters a to f designate patches of about 10 $mm^2$ with variations on six levels of shift amounts between the preceding nozzles and the following nozzles. The six patches a to f form a patch group 1201. These patches are printed on the print medium 201 by forward and backward scans of the print head.

Figure 12:
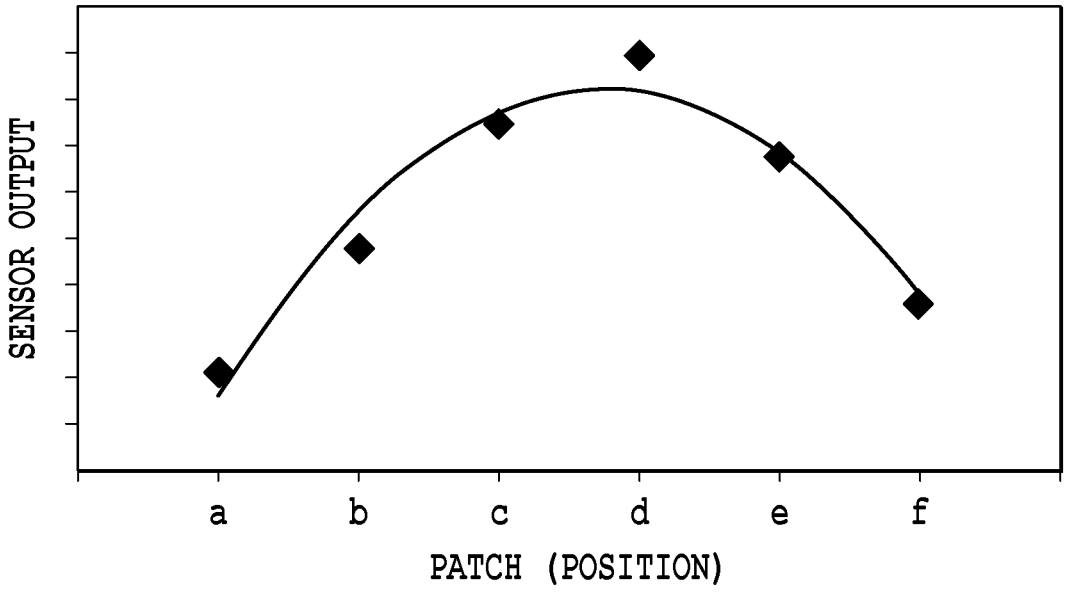
FIG. 12 is a graph illustrating sensor outputs in a case where each of the patches forming one patch group illustrated in FIG. 11 is detected by a sensor.

FIG. 12 is a graph illustrating sensor outputs in a case where each of the six patches a to f forming one patch group illustrated in FIG. 11 is detected by a sensor. In the example illustrated in FIG. 12, the patch d has a lowest density (i.e., a highest lightness) without any position shift. The measurement results (i.e., the sensor outputs) of the six patches a to f are approximated with a predetermined function. Shift amount corresponding to a density in a case where the sensor output is smallest, that is, the density is highest is obtained as the shift amount of the patch group 1201 from the approximation result. In this manner, one landing shift amount in the region in which the patch group is printed is calculated with respect to one patch group.

Figure 13A:
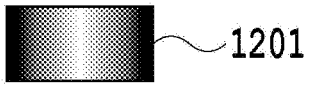
FIGS. 13A to 13C are diagrams illustrating printing a test pattern formed of the plurality of patch groups in association with a main rail for guiding the movement of the carriage.
Figure 13B:
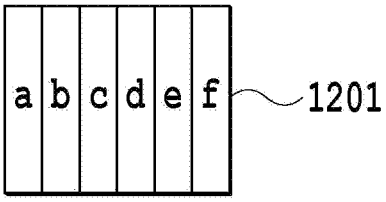
Figure 13C:
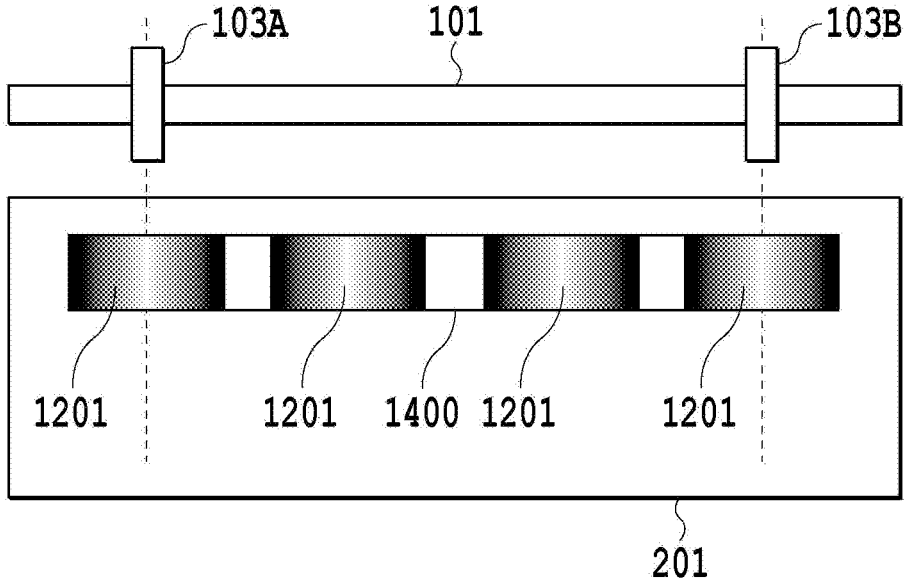

FIGS. 13A to 13C are diagrams illustrating one example of a test pattern 1400 formed of the plurality of patch groups 1201 in association with a support member for a main rail. FIG. 13A illustrates one patch group 1201, which consists of the patches a to f arranged in the main scanning direction, as illustrated in FIG. 13B. Each of the patches a to f corresponds to the patches a to f described above with reference to FIG. 11. FIG. 13C illustrates an example in which the test pattern 1400 is printed such that four patch groups 1201 are printed between adjacent support members 103A and 103B for the main rail. Two out of the patch groups 1201 illustrated in FIG.

13C are printed fully within the region defined between the adjacent support members; however, the other two partly stay within the region. In the present specification, the patch groups, which partly stay within the region, also are counted as the number of patch groups to be printed in the region. Although the four patch groups are printed within the region defined between the main rail support members in the example illustrated in FIG. 13C, the more number of patch groups may be printed in the region defined between the main rail support members, thus detecting the print position shift with higher accuracy.

Figure 14:
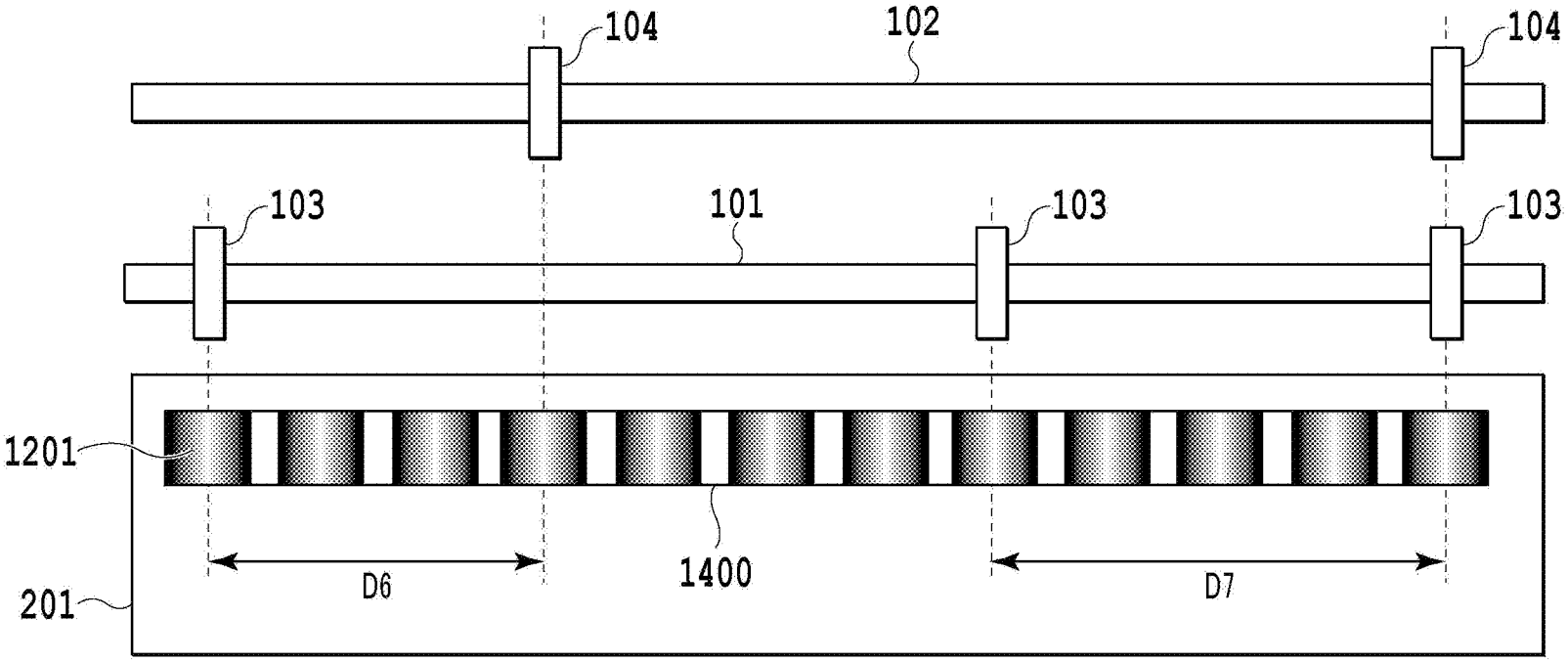
FIG. 14 is a diagram illustrating the relationship between each of a main rail support member and a sub rail support member and the print position of the patch group according to the embodiment of the present invention.

FIG. 14 is a diagram illustrating the print position of the patch group 1201 with respect to the main rail support member 103 and the sub rail support member 104. In the present embodiment, four patch groups 1201 are printed at an interval D6, at which the distance between the main rail support member 103 and the sub rail support member 104 is smallest. Moreover, five patch groups 1201 are printed at an interval D7 defined between the adjacent support members 103 for the main rail. In a normal case in which the main rail and the sub rail are more curved as they become more apart from their support members, the posture change of the carriage occurs in a slightly shorter cycle than the interval D6 between the main rail support member 103 and the sub rail support member 104 or the interval D7 between the two main rail support members. In view of this, it is desirable that as many patch groups as possible should be printed between the main rail support member 103 and the sub rail support member 104 and between the two adjacent main rail support members. Hence, four and five patch groups are printed, respectively, in the present embodiment.

Incidentally, in a case where the print position shift should be actually measured at many positions, and further, intervals between the positions become smaller than the width of the patch group 1201, a plurality of patch groups 1201 may be arranged also at a position, at which the print medium is conveyed and shifted in the sub scanning direction. In this manner, the patch groups can be arranged at proper positions without reducing the size of each of patches. In the present embodiment, the plurality of patch groups are printed between the main rail support member 103 and the sub rail support member 104, thereby forming one test pattern 1400.

Figure 15:
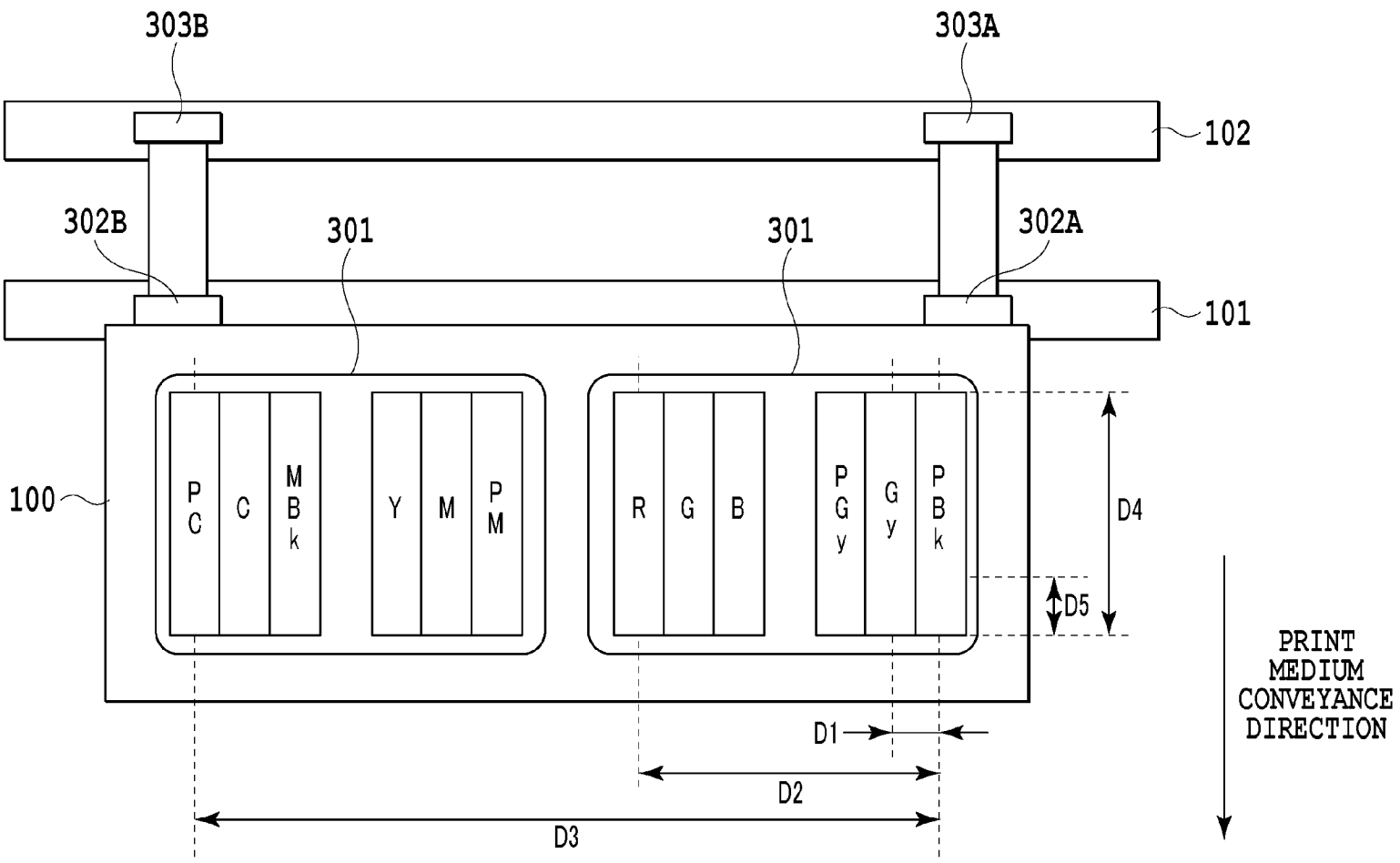
FIG. 15 is a diagram illustrating the positional relationship between the arrangement of the nozzle groups in the print head to be used in the embodiment of the present invention and each of a main rail and a sub rail.

FIG. 15 is a diagram illustrating the positional relationship between the arrangement of the nozzle groups in the print head 301 to be used in the present embodiment and each of the main rail 101 and the sub rail 102. In a case where the posture change of the print head is the pitching or yawing described above with reference to FIG. 4 in printing ink dots with color inks in superimposition by the nozzles for the color inks, the landing position shift between the dots printed by the nozzles becomes larger as the distance between the nozzles becomes longer. As the landing position shift between the dots becomes larger, the accuracy of the detection by the optical sensor becomes more improved. Here, in a case where a rail is curved with the most general flexure, the use of a print head having a longer inter-nozzle distance than the cycle of the flexure makes it difficult to accurately detect the posture change of the print head. Since the rail is curved at the interval between the rail support members, it is desirable to use two nozzles (arrays) relatively positioned within a half or less distance of the interval between the rail support members in printing a test patch in the present embodiment.

The rolling of the carriage occurs on the main rail and the sub rail, and therefore, it most influences the nozzle remote from the main rail and the sub rail, thereby increasing the relative landing position shift. Consequently, it is desirable that the nozzles positioned within a nozzle group D5 positioned most apart from the main rail and the sub rail in a nozzle array D4 in a print medium conveyance direction should be used in printing the patch.

Referring to FIG. 9 again, upon completion of the printing of the test pattern in step S2, the carriage is moved at a low speed with respect to the test pattern printed on the print medium, and further, the optical sensor detects the density of each of the patches in step S3. As described above with reference to FIG. 12, the detected densities of the plurality of patches (i.e., the patch groups) are approximated with a predetermined function curve, thereby obtaining the print shift amount. In this manner, one print shift amount is determined with respect to one patch group, and namely, one position. Here, as described above with reference to FIG. 10, the range of nozzles to be used in a following nozzle array is shifted by a predetermined number of pixels in the sub scanning direction within the range D5, and then, the patch is printed; here, the position shift direction of the print shift amount is determined according to the shift direction.

Next in step S4, the inclination of the carriage (i.e., the print head) is calculated based on the print shift amount and its position shift direction that are obtained in step S3. In other words, the posture of the print head is acquired.

Figure 16:
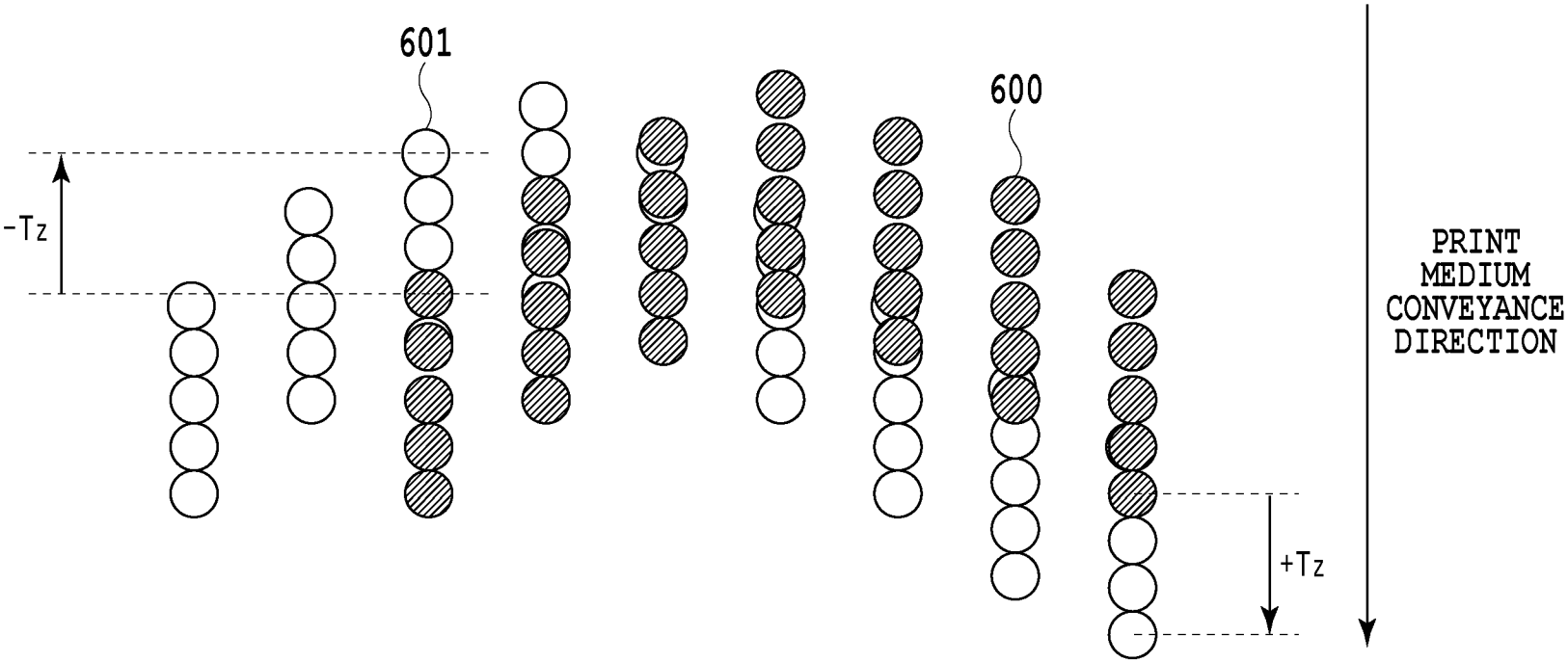
FIG. 16 is a diagram illustrating the landing position shift between print dots formed by a preceding nozzle array and print dots formed by a following nozzle array in the embodiment of the present invention.

FIG. 16 is a diagram illustrating the print position shift between print dots 600 formed by a preceding nozzle array and print dots 601 formed by a following nozzle array. The print shift amount between the print dots 600 formed by the preceding nozzle array and the print dots 601 formed by the following nozzle array is designated by Tz. A case where the print dots 601 formed by the following nozzle array are shifted downstream in the print medium conveyance direction with reference to the print dots 600 formed by the preceding nozzle array is referred to as a plus side: in contrast, a case where the print dots 601 formed by the following nozzle array are shifted upstream in the print medium conveyance direction is referred to as a minus side. In other words, the case where the print dots 601 formed by the following nozzle array are shifted downstream in the print medium conveyance direction with reference to the print dots 600 formed by the preceding nozzle array is designated by +Tz: in contrast, the case where the print dots 601 are shifted upstream is designated by −Tz. In this manner, the print shift amount has the sign. The print shift amount with the sign is denoted by reference character Iz. Therefore, Iz is expressed by the following equation:

$$Iz=\pm Tz \qquad \text{Equation 1}$$

Figure 17A:
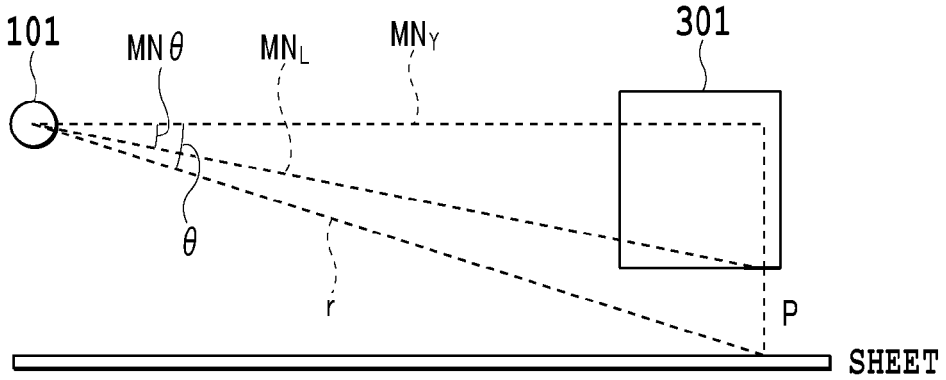
FIGS. 17A and 17B are diagrams illustrating a change in positional relationship between the main rail and a nozzle for printing the test pattern, the change being caused by a posture change, in the embodiment of the present invention.
Figure 17B:
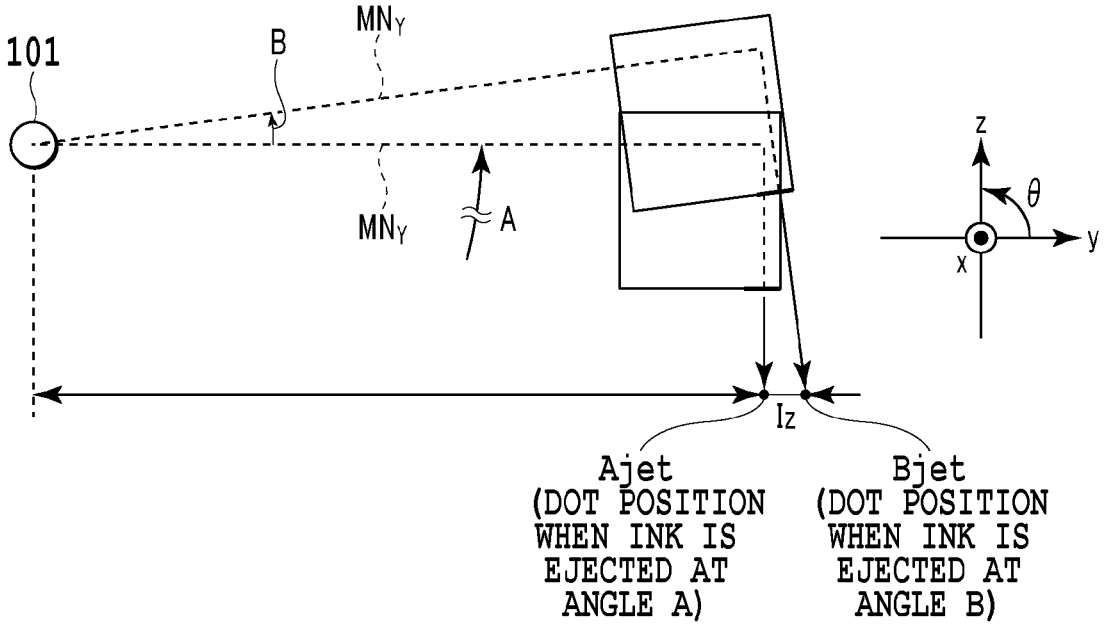

FIGS. 17A and 17B are diagrams illustrating a change in positional relationship between the main rail 101 and a nozzle for printing the test pattern, the change being caused by the posture change, in the embodiment of the present invention. Variables illustrated in FIGS. 17A and 17B are as follows:

$MN_Y$: a distance (a straight line) in the conveyance direction between the main rail and the nozzle $MN_L$: a distance (a straight line) between the main rail and the nozzle $MN_\theta$: an angle formed between a straight line $MN_Y$ and a straight line $MN_L$ P: a distance between the nozzle of the print head and the print medium B: an angle of the posture change of the print head in a case where the dots are printed by the following nozzles with reference to the case where the dots are printed by the preceding nozzles FIG. 17A illustrates the posture of the print head in printing the patches for the test pattern, and further, a reference of an angular change caused by a posture change in a case where the print medium and the print head are parallel to each other. In the meantime, FIG. 17B illustrates a state turned at an angle (A+B) from the reference illustrated in FIG. 17A. In other words, assuming that reference character A denotes the angle of the print head in a case where the dots are printed by the preceding nozzles, and further, the print head 301 is further turned by the angle B since the dots are printed by the preceding nozzles until the dots are printed by the following nozzles, the inclination from the reference becomes (A+B). A difference B in inclination is calculated as an inclination of the carriage (i.e., the print head) per patch in the present embodiment. As described later in step S5 in FIG. 9, the posture of the print head is varied such that the inclination B is cancelled. Equations deriving the inclination angle B of the print head based on the relationship illustrated in FIGS. 17A and 17B are as follows:

$$MN_Y = MN_L\cos(MN)_\theta \qquad \text{Equation 2}$$

$$Z = MN_L\sin(MN_\theta) + P$$

$$\theta = \tan^{-1}\left(\frac{Z}{MN_Y}\right)$$

$$r = \sqrt{MN_Y^2 + Z^2}$$

$$Iz = B_{jet} - MN_L\cos(MN_\theta + A) - P\sin A$$

$$B_{Jet} = Iz + MN_L\cos(MN_\theta + A) + P\sin A$$

$$\therefore B = \theta - \cos^{-1}\left(\frac{B_{jet}}{r}\right)$$

In the above equations and FIG. 17B, reference characters Ajet and Bjet denote Y coordinates of the positions of the dots printed by the print head having the postures at the angles A and B, respectively. The position shift Iz between the dots printed by the preceding nozzles and the dots printed by the following nozzles can be expressed as Bjet-Ajet. Assuming that the angles A and B are relatively small, Ajet is expressed with the approximation: Ajet=$MN_L$ cos($MN_\theta$+A)+P sin A. With this relationship, the inclination B can be eventually obtained based on Equation 2.

Referring to FIG. 9 again, the inclination of the carriage is calculated in step S4. And then, the drive amount of an actuator that acts in such a manner as to cancel the posture change of the carriage is calculated in step S5 based on the inclination of the carriage obtained in step S4.

Figure 18A:
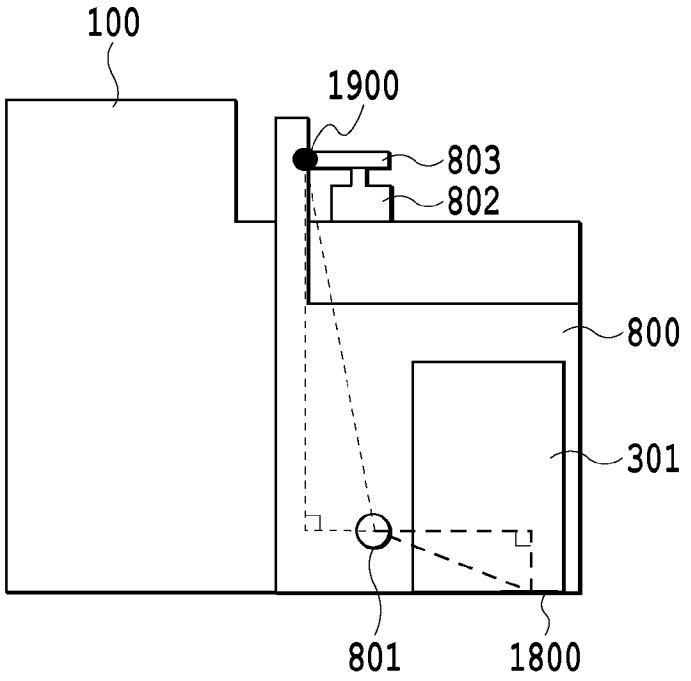
FIGS. 18A to 18C are diagrams illustrating the drive amount of an actuator that acts in such a manner as to cancel the posture change of the carriage in the embodiment of the present invention.
Figure 18B:
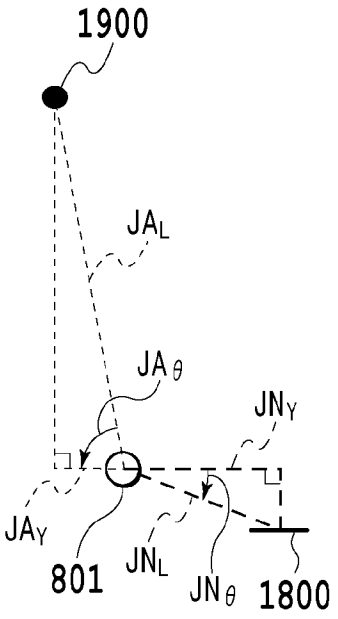

FIG. 18A illustrates the positional relationship between a displacement point, at which force acts according to the drive of the posture control actuator, and the nozzle to be used for printing the test pattern; FIG. 18B simplifies FIG. 18A; and FIG. 18C is a diagram illustrating a case where a pulse motor 802 serving as the posture control actuator is driven, and then, rolling is generated on a shaft.

Figure 18C:
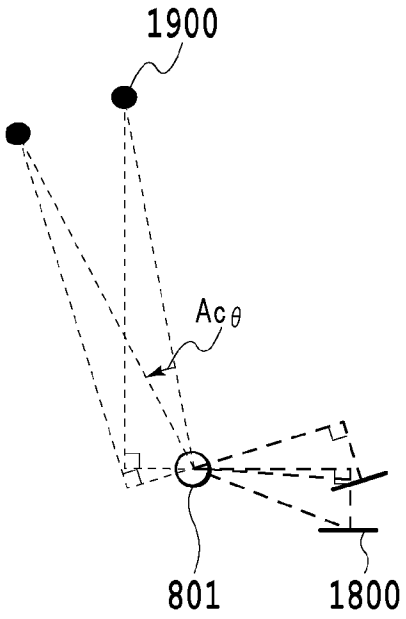

As illustrated in FIG. 18C, a displacement angle $AC_\theta$ for canceling the inclination B obtained in accordance with Equation 2 above is expressed by the following Equation 3:

$$AC_\theta = -B \qquad \text{Equation 3}$$

The drive amount of the actuator for achieving the displacement angle $Ac_\theta$ is obtained in accordance with Equation 4 below based on the relationship illustrated in FIGS. 18A and 18B. Specifically, in the present embodiment, the drive of the pulse motor 802 produces a displacement $Ac_Y$ in the print medium conveyance direction (i.e., the Y direction) by a cam 803 fixed to the pulse motor, thereby displacing the print head 301 by an angle $Ac_\theta$ on a shaft 801.

$$AC_Y = JA_L\cos(JA_\theta - AC_\theta) - JA_Y \qquad \text{Equation 4}$$

Here, $JA_Y$ designates a distance in the conveyance direction between the shaft and the displacement point; $JA_L$, a distance between the shaft and the displacement point; and $JA_\theta$, an angle formed by straight lines $JA_Y$ and $JA_L$. The pulse motor is driven with the drive amount $AC_Y$ obtained in accordance with Equation 4, thus suppressing the posture change of the carriage.

Referring to FIG. 9 again, after the actuator drive amount is calculated in step S5, the actuator drive amount at each of the positions of the carriage obtained in step S5 is stored in a ROM of the apparatus in step S6. In this manner, the posture correction control amount calculation comes to an end.

Figure 19:
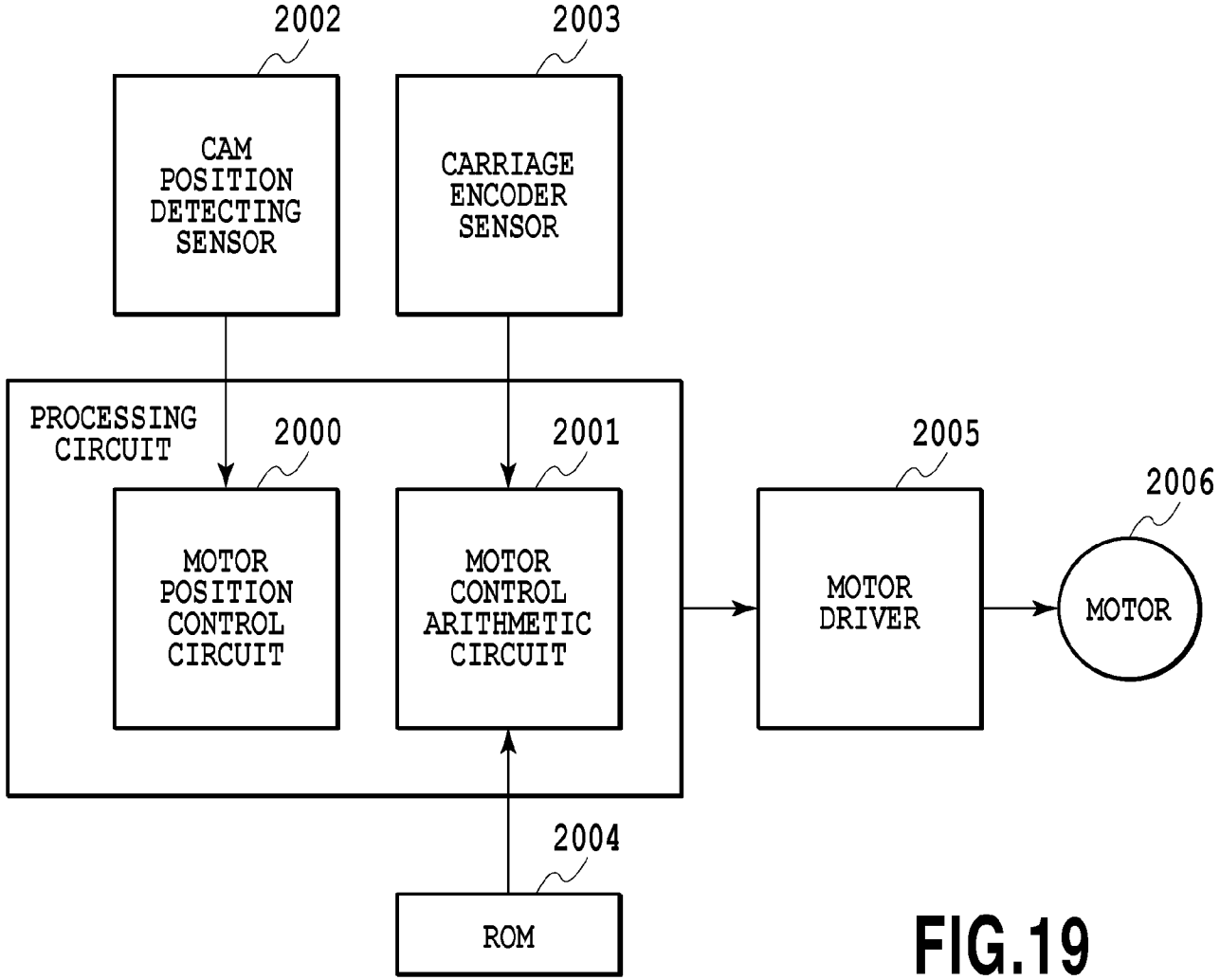
FIG. 19 is a block diagram illustrating the arrangement for the carriage posture correction control according to the embodiment of the present invention.

FIG. 19 is a block diagram illustrating the arrangement for the carriage posture correction control according to the above-described embodiment of the present invention. Motor control arrangement includes a motor position control circuit 2000 and a motor control arithmetic circuit 2001.

In FIG. 19, a cam position detecting sensor 2002 including the position reference plate 900 (see FIG. 8) fixed to the cam, the photointerrupter, and the like detects the initial position of a motor. The motor position control circuit 2000 processes a result output from the cam position detecting sensor, thus controlling the motor in such a manner as to drive it up to its initial position.

In a case where the print head scans the print medium so as to perform printing, a carriage encoder sensor 2003 detects the position of the carriage, and then, the motor drive amount at this position of the carriage is read from a ROM 2004. The motor control arithmetic circuit 2001 produces a pulse signal based on the read drive amount. Thereafter, the produced pulse signal is input into a motor driver 2005, thereby driving a motor 2006. To the motor 2006 is fixed the cam illustrated in FIG. 8. As described above, a displacement is produced in a direction in which the posture change of the carriage is cancelled, so that the head is rolled, thus performing the carriage posture correction control.

As described above, according to the embodiment of the present invention, the posture change of the carriage that is printing is corrected, and then, the carriage is moved in a predetermined posture, so that the print position shift of the dot in association with the posture change of the carriage is suppressed, thus improving the quality of a print image. Moreover, the posture change of the carriage is detected to be suppressed, thus allowing a carriage rail to be slightly curved. In summary, not only the quality of a print image is improved, but also the selection of a carriage rail member that cannot be curved is eliminated or an increase in cost (i.e., product price) paid for enhancing assembling accuracy is reduced.

The above-described advantageous results are prominent in a large-sized printing apparatus. Specifically, the print position shift according to the embodiment of the present invention is conspicuous in a large-sized printing apparatus capable of printing a relatively large print medium. In the case of a relatively small-sized printing apparatus, the above-described posture change of the print head is small, thereby hardly inducing a problem in view of a print image. In contrast, in the case of a large-sized printing apparatus, the movement distance of a print head is long, and therefore, the posture change of the print head becomes large even if, for example, a guide rail for guiding and supporting a carriage is slightly curved in a main scanning direction.

Incidentally, it is obvious from the above description that the application of the present invention is not limited to the printing apparatus of the ink jet system described above by way of the present embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-090373, filed Apr. 23, 2013, which is hereby incorporated by reference herein in its entirety.

What is claimed is:

1. A printing apparatus comprising:

a print head which includes a surface in which nozzles for ejecting ink are formed;

a moving unit configured to mount the print head and move in a first direction;

a platen positioned to face the print head for supporting a print medium;

a pattern printing unit configured to cause the print head to print a plurality of test patterns at each of a plurality of different positions in the first direction on the print medium;

a measuring unit configured to measure the plurality of test patterns printed on the print medium;

a changing unit configured to change an angle of the print head with respect to the platen by moving the print head such that the direction of a line perpendicular to the surface is changed; and a control unit configured to cause the changing unit to change the angle of the print head corresponding to positions of the print head in the first direction, based on measurement results by the measuring unit.

2. The printing apparatus according to claim 1, wherein the print head comprising a plurality of print elements, and each of the plurality of test patterns is formed with a plurality of patches that differ from each other in a shifted amount of print positions.

3. The printing apparatus according to claim 1, wherein said pattern printing unit makes a cycle of the plurality of positions at which the test pattern is printed smaller than a cycle of support members for a rail that guides a move of the print head by said moving unit.

4. The printing apparatus according to claim 1, wherein said pattern printing unit determines the plurality of positions at which the test pattern is printed corresponding to positions at which support members supporting a rail that guides a move of the print head by said moving unit.

5. The printing apparatus according to claim 1, wherein said pattern printing unit further causes the print head to print the test pattern at a position shifted from the plurality of positions in a second direction crossing the first direction.

6. The printing apparatus according to claim 1, wherein the print head comprising a plurality of print elements, and among the plurality of print elements, said pattern printing unit uses a plurality of print elements positioned within a range including a print element positioned most apart from a rail that guides a move of the print head by said moving unit so as to cause the print head to print the test pattern.

7. A posture change correcting method for a print head comprising:

a step of providing a print head which includes a surface in which nozzles for ejecting ink are formed;

a step of providing a moving unit configured to mount the print head and move in a first direction;

a step of providing a platen positioned to face the print head for supporting a print medium;

a step of causing the print head to print a test pattern at each of a plurality of different positions in the first direction on the print medium, a step of measuring the plurality of test patterns printed on the print medium;

a step of changing an angle of the print head with respect to the platen by moving the print head such that the direction of a line perpendicular to the surface is changed; and a step of causing the angle of the print head to change, per the step of changing an angle of the print head, corresponding to positions of the print head in the first direction, based on the results of measuring the plurality of test patterns printed on the print medium.

8. The posture change correcting method according to claim 7, wherein the print head comprising a plurality of print elements, and each of the plurality of test patterns is formed with a plurality of patches that differ from each other in a shifted amount of the print positions.

* * * * *